US005090135A

United States Patent [19]

Wolf et al.

[11] Patent Number: 5,090,135

[45] Date of Patent: Feb. 25, 1992

[54] DEVICE FOR REMOVAL OF CONDENSATE FROM A STEAM-HEATED DRYING CYLINDER

[75] Inventors: Robert Wolf; Karl Steiner, both of Herbrechtingen, Fed. Rep. of Germany

[73] Assignee: J. M. Voith GmbH, Heidenheim, Fed. Rep. of Germany

[21] Appl. No.: 732,822

[22] Filed: Jul. 19, 1991

[30] Foreign Application Priority Data

Jul. 27, 1990 [DE] Fed. Rep. of Germany ..... 4023871

[51] Int. Cl.[5] ..... F26B 13/08

[52] U.S. Cl. ..... 34/124; 34/119; 34/125

[58] Field of Search ..... 34/119, 124, 125; 165/89, 90

[56] References Cited

U.S. PATENT DOCUMENTS

| | | | |
|---|---|---|---|
| 4,359,829 | 11/1982 | Schiel | 34/124 |
| 4,384,412 | 5/1983 | Chance et al. | 34/119 |
| 4,476,637 | 10/1984 | Justus et al. | 34/124 |
| 4,498,249 | 2/1985 | Cooke et al. | 34/119 |
| 4,501,075 | 2/1985 | Jenkner et al. | 34/124 |
| 4,516,334 | 5/1985 | Wanke | 34/124 |
| 4,606,136 | 8/1986 | Pflug | 34/119 |
| 4,691,452 | 9/1987 | Ferguson | 34/124 |
| 4,718,177 | 1/1988 | Haeszner et al. | 34/124 |

*Primary Examiner*—Henry A. Bennet
*Assistant Examiner*—Denise L. F. Gromada
*Attorney, Agent, or Firm*—Baker & Daniels

[57] ABSTRACT

A condensate suction pipe rotating with the drying cylinder extends from the area of the axis of rotation of the drying cylinder toward the inside surface of the cylinder shell, and has there a suction opening for the intake of condensate mixed with steam. A steam blowing line originating from the cylinder interior empties in the area of the suction opening into the interior of the condensate suction pipe. The steam blowing line is fashioned as an annular channel defined by the radially outer (relative to the cylinder axis) area of the condensate suction pipe and by an outside pipe surrounding the condensate suction pipe.

5 Claims, 2 Drawing Sheets

DEVICE FOR REMOVAL OF CONDENSATE FROM A STEAM-HEATED DRYING CYLINDER

BACKGROUND OF THE INVENTION

The invention concerns a device for the removal of condensate from a steam-heated drying cylinder, specifically for a paper machine. A condensate suction tube rotating with the drying cylinder extends from the area of the axis of rotation of the drying cylinder toward the inside surface of the cylinder shell and has a suction opening for picking up condensate mixed with steam. A steam blowing line originating from the cylinder interior and featuring an annular channel empties in the area of the suction opening in the interior of the condensate suction pipe. Drying cylinders of this type preferably serve in paper machines for drying a newly formed paper web.

Experts call such a device for condensate removal briefly a "rotating siphon." This design has the advantage that no relative movement is taking place between the revolving drying cylinder and the condensate suction pipe, since the condensate suction pipe is rigidly fastened in the drying cylinder, with both then rotating jointly. Another known type of siphon design is the stationary siphon, which does not share the rotary movement of the drying cylinder.

In regular drying cylinders, such as that described in U.S. Pat. No. 4,718,177 the cylinder shell has a smooth inside wall, on which the condensate to be removed, at higher machine speed, is forming a ring. There is mostly only a single condensate suction pipe present, for instance with a bell or dish-shaped suction mouthpiece.

In the case of glazing or crepe cylinders, such as described in U.S. Pat. No. 4,359,829, the diameter of which amounts to 2 to 4 times that of a regular drying cylinder, the inside of the cylinder shell is provided with peripheral grooves in which the condensate to be removed is collected. Therefore, there is at least one condensate collection pipe provided which extends approximately parallel to the cylinder axis and rotates with the cylinder, and to which numerous radial siphon tubelets are connected which extend into the grooves. In this case, the condensate suction pipe protrudes into the interior of the condensate collection pipe so as to suck the condensate out.

The removal of the condensate is accomplished in all cases in that inside the drying cylinder a higher steam pressure is adjusted than in the condensate suction pipe (facultatively including the suction mouthpiece). Due to this "differential pressure," part of the supplied steam continuously exits outside through the rotating siphon, mixing with a certain amount of condensate and feeding it outside.

In regular drying cylinders it is also known to provide an additional steam blowing line that originates from the cylinder space and empties in the region of the suction opening of the condensate suction pipe. This makes is possible to exert an increased transport effect on the condensate. Specifically, it is possible to ensure with the aid of such an additional steam blowing line that the removal of the condensate will also be assured (or restarted), when too much condensate has accumulated as a result of any disturbance or in the case of a temporary standstill of the drying cylinder. In this case, the suction opening of the condensate suction pipe may at least temporarily be flooded by the condensate, causing the normal condensate transport to be disrupted; i.e., the condensate removal is temporarily taking place only through that steam which through the additional steam blowing line is fed to the condensate suction pipe.

It is known to provide as an additional steam blowing line simply a bore extending through the wall of the condensate suction pipe (U.S. Pat. No. 2,993,282). However, such a bore must be arranged a relatively short distance from the suction opening of the condensate suction pipe, giving rise to the risk that now and then the bore will also be flooded.

Other prior designs avoid this disadvantage: according to the previously cited U.S. Pat. No. 4,718,177, the additional steam blowing line extends from the side into the interior of the suction mouthpiece and then along the inside surface of the cylinder shell and through the suction mouthpiece. Although with this prior design the desired effect is actually achievable, there is a desire for further improvement.

According to the German patent document 24 13 271, on which the invention is based, there is a steam blowing line provided which is arranged coaxially within the condensate suction pipe; it features inside the suction mouthpiece a reversing device that forms an annular channel. Thus, the additional steam is fed to the interior of the condensate suction pipe in such a way that it will be evenly distributed across the circumference of the condensate suction pipe. The objective with this known arrangement is to increase the transport effect of the additional steam on the condensate; however, this is not sufficiently accomplished because the installations required in the condensate suction pipe and in the suction mouthpiece cause relatively high flow resistances. In other words, the installations slow down the condensate flow, so that a relatively high differential pressure is needed, which results in a relatively high steam consumption. In addition, the installations are relatively expensive. Furthermore, it is very difficult or even entirely impossible to retroactively equip a present condensate suction pipe with the steam blowing line.

The problem underlying the invention is to design a condensate removal device featuring an additional steam blowing line so that the steam consumption caused by the additional steam blowing line, as compared with prior designs, will be reduced while nonetheless a maximally high transport effect is exerted on the condensate to be removed.

SUMMARY OF THE INVENTION

This problem is solved through the features of the present invention. According to the invention, an annular channel is again provided for the supply of the additionally transported steam, similar to the objective described in German patent document 24 13 271, but in an entirely different form. Further, an outside pipe is provided which surrounds the condensate suction pipe, and together with it forms the said annular channel. This annular channel terminates a maximally short distance from the inside surface of the cylinder shell. From here, the additional steam is fed to the interior of the condensate suction pipe; this, in turn, may take place relatively uniformly across the circumference of the condensate suction pipe. An essential difference from the prior designs, specifically German patent document 24 13 271, however, is that installations of any sort are required neither inside the condensate suction pipe nor inside the suction mouthpiece, which installations would be suited to decelerate the condensate flow.

Thus, as compared with the aforementioned prior arrangements, an essentially improved transport effect on the condensate is achieved. In other words, the economy of the condensate transport is significantly increased, for it is possible to provide in the additional steam blowing line designed as an annular channel relatively small flow cross sections, so that the passing steam quantity will be relatively small.

Another difference from the prior art is seen in the fact that the additional steam blowing line is formed exclusively or at least predominantly only through the annular channel, namely by adding the said outside pipe to the condensate suction pipe. The inventional design thus makes is possible to retroactively outfit the condensate suction pipe or its suction mouthpiece at an extremely low expense with the outside pipe and to connect the annular channel thus created, through a collar of channels arranged a maximally short distance from the cylinder shell, with the interior of the condensate suction pipe.

Another advantage of the inventional design is that the design is also applicable without any difficulties in glazing or crepe cylinders (which are smooth or grooved on the inside), where at least one condensate suction pipe extends into a condensate collection pipe that is parallel to the cylinder axis.

Designed as an annular channel, the inventional steam blowing line can advantageously be combined with a device arranged inside the condensate suction pipe or suction mouthpiece for generating a rifling in the condensate flow according to U.S. Pat. No. 4,924,603.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein are not to be construed as limiting the scope of the invention in any manner.

DESCRIPTION OF THE PREFERRED EMBODIMENT

Figure 1:
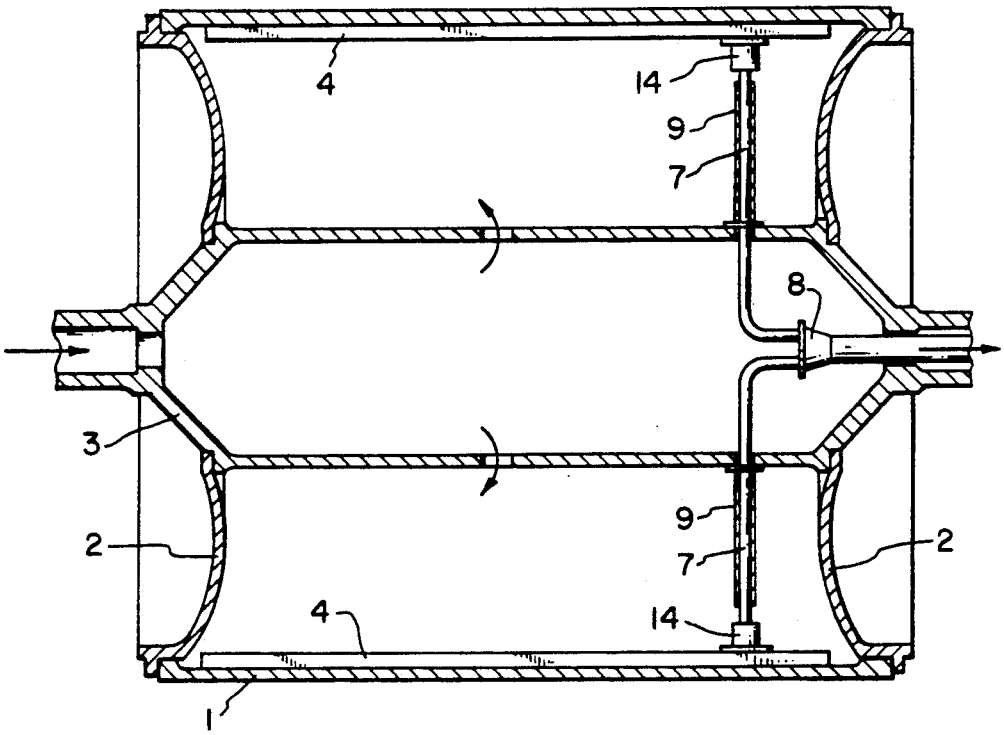
FIG. 1 shows a glazing or crepe cylinder (also called a Yankee cylinder) in longitudinal section.

Depicted in FIG. 1 is a cylinder shell 1 supported by a hollow shaft 3 by means of two lids 2. Near the inside wall of the cylinder shell 1 there extend two condensate collection pipes 4, parallel to the cylinder axis of rotation and essentially across the entire length of the cylinder shell 1. Each of the condensate collection pipes 4 connects through a radial condensate suction pipe 7 with a drain line 8 arranged coaxially with the hollow shaft 3.

Figure 2:
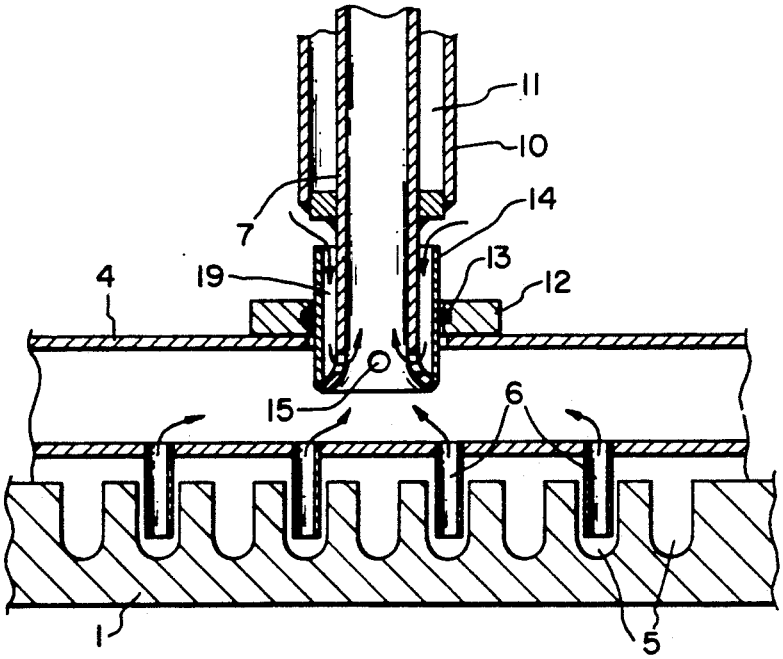
FIG. 2 shows an enlarged section of FIG. 1.

As is evident from FIG. 2, the inside of the cylinder shell 1 is provided with numerous peripheral grooves 5. Siphon tubelets 6 protrude into these peripheral grooves 5 and empty into the interior of the condensate collection pipe 4. Thus, the condensate accumulating in the grooves 5 proceeds in known fashion through the siphon tubelets 6 into the condensate collection pipe 4, and from there through the condensate suction pipe 7 into the drain pipe 8. This condensate transport is primarily brought about in that of the steam (mainly serving the heat supply of the cylinder shell) a part is removed to the outside along with the condensate, along the path just described.

Occasionally, it may happen that at least part of the grooves 5 fill up with condensate to a point such that the inlets of the siphon tubelets 6 will be flooded. As a result, steam can no longer flow via the siphon tubelets 6 into the condensate collection pipe 4. Consequently, less condensate than is continuously newly created on the inside of the cylinder shell 1 is being removed to the outside. This may entail that also the condensate collection pipes 4 will gradually fill up as well with condensate. To avoid this and to achieve again an increase in the condensate amount removed, the following is provided: arranged around the outer area of the condensate suction pipe 7, i.e., specifically around its radially outer end, is a coaxial outside pipe 14. It is preferably fastened to it in the area of the suction opening of the condensate suction pipe 7. It extends together with the condensate suction pipe 7 through a packing support 12 (with packing 13) in a direction toward the cylinder axis of rotation. The outside pipe 14 is open at its radially inner end (relative to the cylinder axis of rotation), so that between the two pipes 7 and 14 there is an annular channel 19 created which is open toward the interior of the cylinder. This channel connects on its radially outer end, i.e., as near as possible to the cylinder shell 1, by way of several openings 15 with the interior of the condensate suction pipe 7. The annular channel 19 and the openings 15 thus form a steam blowing line. Fed along this way, the steam exerts a transport effect on the condensate also when the suction opening of the condensate suction pipe 7 should happen to be flooded. The same principle of design is applicable also in Yankee cylinders with a smooth inside of the cylinder shell.

According to FIG. 2, the suction opening of the condensate suction pipe 7 is situated approximately in the center of the cross section of the condensate collection pipe 4. In variation thereof, the two pipes 7 and 14 may be extended, thus shifting the suction opening in the direction of the cylinder shell 1.

According to FIG. 1, a thermal insulation 9 is provided on the condensate suction pipes 7. This insulation, according to FIG. 2, is fashioned as an outside pipe 10 which together with the condensate suction pipe 7 defines an annular space 11 which, e.g., may be filled with a thermally insulating gas.

Figure 3:
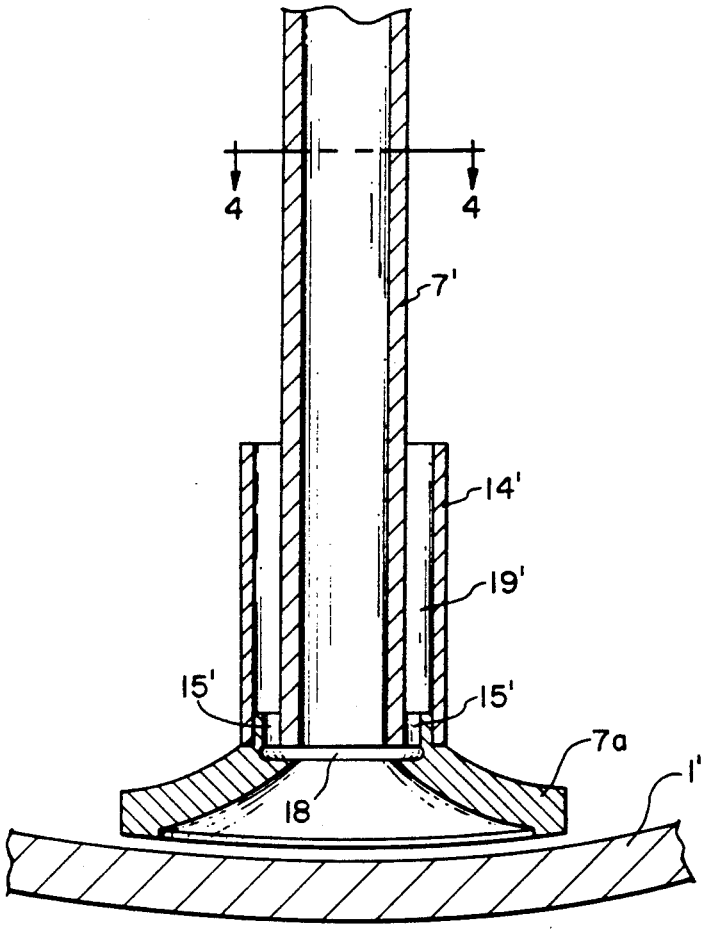
FIG. 3 shows a section through the condensate suction pipe of a regular drying cylinder.
Figure 4:
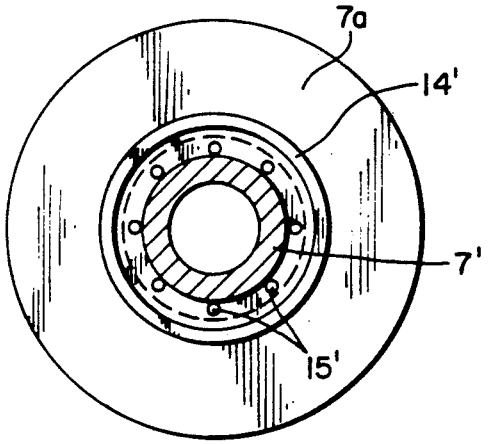
FIG. 4 shows a cross-section along line IV-IV of FIG. 3.

FIGS. 3 and 4 illustrate a condensate suction pipe 7' with a suction mouthpiece 7*a* whose suction opening is adapted to the smooth inside wall of a regular drying cylinder shell 1'. Fastened at the connection point between the condensate suction pipe 7' and the suction mouthpiece 7*a*, to the suction mouthpiece, is an outside pipe 14' which together with the condensate suction pipe 7' defines an annular space 19'. This space, as in FIG. 2, is open toward the cylinder axis of rotation. Several bores 15', parallel with the pipe axis, connect the annular channel 19' through an annular recess 18 with the interior of the condensate suction pipe 7'. The effect of this, again, is that additional transport steam can flow into the interior of the condensate suction pipe 7', via the annular channel 19', and at that, a maximally short distance from the inside surface of the cylinder shell 1'.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for the removal of condensate from a steamheated rotatable drying cylinder, said drying cylinder having an axis of rotation and further having an outer shell, said outer shell having an inside surface, said device comprising;

a condensate suction pipe rotatable with said drying cylinder and extending generally from said drying cylinder axis of rotation toward said inside surface of the shell, said condensate suction pipe having a radially inner portion and a radially outer portion relative to said axis of the drying cylinder, said radially outer portion terminating in a suction opening for receiving condensate mixed with steam from the interior of said drying cylinder; and an outside pipe surrounding at least part of the exterior of said radially outer portion of the condensate suction pipe, said outside pipe being situated so that an annular channel is defined by said outside pipe and said radially outer portion, said annular channel comprising a steam blowing line wherein said steam blowing line originates from the interior of said drying cylinder and empties generally at said suction opening of the suction pipe.

2. The device according to claim 1, in which said outside pipe is fastened on said condensate suction pipe, wherein said fastened portion is situated in closely spaced relationship to said suction opening.

3. The device according to claim 1, in which said cylinder comprises a glazing or crepe cylinder having at least one condensate collection pipe that extends generally parallel to said cylinder axis along said cylinder shell inside surface, said condensate collection pipe having an interior, wherein said outside pipe and said condensate suction pipe protrude into said condensate collection pipe interior.

4. The device according to claim 3, wherein said inside surface of the cylinder shell includes peripheral grooves, and said condensate collection pipe includes a plurality of siphon tubelets extending outwardly from said collection pipe, said tubelets being situated so that they extend into said peripheral grooves.

5. The device according to claim 2, including a suction mouthpiece arranged at the radially outer end of said condensate suction pipe, wherein said outside pipe is fastened on said suction mouthpiece, said suction mouthpiece forming at least one line connection from said annular channel to the interior of said condensate suction pipe.

* * * * *